US006558884B1

(12) United States Patent
Greener et al.

(10) Patent No.: US 6,558,884 B1
(45) Date of Patent: May 6, 2003

(54) PHOTOGRAPHIC FILM BASE COMPRISING A POLY(ETHYLENE TEREPHTHALATE)-BASED MATERIAL

(75) Inventors: Jehuda Greener, Rochester, NY (US); Yuanqiao Rao, Rochester, NY (US); Dennis J. Massa, Pittsford, NY (US); Yeh-Hung Lai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/036,668

(22) Filed: Dec. 21, 2001

(51) Int. Cl.[7] ..... G03C 1/795
(52) U.S. Cl. ..... 430/502; 430/533
(58) Field of Search ..... 430/533, 502

(56) References Cited

U.S. PATENT DOCUMENTS

| | | | | |
|---|---|---|---|---|
| 3,326,689 A | | 6/1967 | Fix | |
| 4,141,735 A | | 2/1979 | Schrader et al. | 430/533 |
| 5,034,263 A | | 7/1991 | Maier et al. | 430/533 |
| 5,288,601 A | | 2/1994 | Greener et al. | 430/533 |
| 5,326,689 A | * | 7/1994 | Murayama | 430/533 |
| 5,387,501 A | | 2/1995 | Yajima et al. | 430/533 |
| 5,556,739 A | | 9/1996 | Nakanishi et al. | 430/533 |
| 5,925,507 A | | 7/1999 | Massa et al. | 430/533 |
| 6,183,848 B1 | | 2/2001 | Turner et al. | 428/221 |
| 6,232,054 B1 | | 5/2001 | Okutu et al. | 430/533 |

FOREIGN PATENT DOCUMENTS

WO WO 01/34391 A1 5/2001

* cited by examiner

*Primary Examiner*—Richard L. Schilling
(74) *Attorney, Agent, or Firm*—Chris P. Konkol

(57) ABSTRACT

This invention relates to a poly(ethylene terephthalate)-based photographic film base having improved properties with regard to cutting, perforating, and other finishing or phototofinishing operations. The film base comprises a material in which a specified amount of monomeric units derived from 1,4-cyclohexane dimethanol (CHDM), such that the film base has a specified cutting-related property. The level of CHDM in the PET-based polyester material can be adjusted either by physical blending of polyesters containing CHDM monomeric units or by synthetic incorporation of CHDM monomer units into a PET-based polyester backbone.

20 Claims, No Drawings

PHOTOGRAPHIC FILM BASE COMPRISING A POLY(ETHYLENE TEREPHTHALATE)-BASED MATERIAL

FIELD OF THE INVENTION

This invention relates to a polyester photographic film base having improved properties and to a method of preparing the same. More particularly, the invention relates to a poly(ethylene terephthalate)-based photographic film base having improved properties with regard to cutting, perforating, and other finishing or photofinishing operations. The film base is made of a poly(ethylene terephthalate)-based material comprising a specified amount of monomeric units derived from 1,4-cyclohexane dimethanol, such that the film base has a specified cutting-related property.

BACKGROUND OF THE INVENTION

Silver-halide photographic elements comprise one or more light-sensitive layers coated on a support. Typically the support comprises a sheet of a transparent or translucent film, commonly referred to as a film base. Other layers, such as backing or subbing layers, may be laminated onto either side of the film base. Common film-base materials for photographic elements are cellulose triacetate (CTA) and poly(ethylene terephthalate) (PET). More recently it has been proposed to use poly(ethylene naphthalate) (PEN) as a film base for photographic elements which are intended to be used in a cartridge of reduced diameter which requires rolling the film more tightly than previously.

CTA has generally a good mix of physical properties for various types of photographic films. However, its manufacturing process involves high levels of gaseous emissions, and it is relatively costly. The manufacturing process for PET, on the other hand, is environmentally benign. Poly (ethylene terephthalate) (PET) films exhibit excellent properties for use as photographic film base with regard to transparency, dimensional stability, mechanical strength, resistance to thermal deformation. However, compared to CTA, PET films are extremely tough and, therefore, not well suited for finishing operations, i.e., slitting, chopping and/or perforating processes, which are required in the manufacture or preparation of photographic films. Moreover, such films are difficult to cut in various steps of the photofinishing process such as splicing, notching, and sleeving. This is one of the reasons that PET materials have been considered unusable as a film base in certain consumer photographic film applications, such as 35 mm film, especially consumer films requiring non-centralized external processing or minilab processing where finishing must be easily handled. PET materials are presently used in photographic films in which less decentralized processing is not required, for example, X-ray films, motion picture films, and graphic arts films. With respect to the latter types of films, adjustments to processing can be more easily made to handle cutting and the like.

Another general problem with PET film is its tendency to take up high levels of curl during storage in cartridges at high temperatures and its inability to sufficiently lower this curl during photoprocessing as commonly exhibited by CTA-based photographic films. A solution to the latter problem was proposed in U.S. Pat. No. 5,556,739 to Nakanishi et al., U.S. Pat. No. 5,387,501 to Yajima et al., and U.S. Pat. No. 5,288,601 to Greener et al. in which multilayered supports comprise polyesters modified by sulfonate and other hydrophilic moieties that facilitate, in wet processing, recovery of curl imposed on the film during storage in a cartridge. Another general approach to lowering the tendency of a polyester film base to take up curl (core-set) during storage is through annealing at elevated temperature and/or by raising the glass transition temperature (Tg) of the polyester.

U.S. Pat. No. 5,326,689 to Murayama discloses-glow discharge treatment for improved curl of a film base made from a polyester material, preferably a PEN material. In one case, the polyester material comprises a PET-type material in which 25 mol % of the glycol component repeat units are derived from CHDM. U.S. Pat. No. 5,294,473 to Kawamoto similarly discloses a PET polyester film base in which 25 mol % of the glycol component repeat units are derived from CHDM, with improved (reduced) curl.

U.S. Pat. No. 5,925,507 to Massa et al. discloses a PET film-base material having less tendency to core set, comprising polyester containing at least 30 weight % 1,4-cyclohexane dimethanol (CHDM), which polyester is blended with a polycarbonate that contains bisphenol. U.S. Pat. No. 4,141,735 to Schrader et al. discloses a polyester film base having improved core-set curl, involving the use of heat tempering, in one example using poly(1,4-cyclohexylene dimethylene terephthalate), also referred to as "PCT."

The use of high heat-set temperature during the film-base manufacturing process has also been used to improve the finishability of PET-based photographic film. However, even with the demonstrated improvements in finishability, the PET-based film is still difficult to cut in various steps of the photofinishing process. U.S. Pat. No. 5,034,263 to Maier et al. disclosed a laminated film comprising a poly(ethylene terephthalate) core and, on at least one surface thereof, an overcoat of a poly(1,4-cyclohexylene dimethylene terephthalate) polyester, in order to allow the laminated film to be readily slit and perforated using techniques commonly employed with consumer film. Maier et al. states that the CHDM component should comprise at least 70 mol % of the glycol component of the polyester. However, such laminates have been found prone to delamination.

The blending or copolymerizing of conventional polyester with other polyester constituents (polymers or comonomers), in order to improve the cutting performance of a film, has also been proposed for PEN-based polyester films, as disclosed in U.S. Pat. No. 6,232,054 B1 to Okutu et al. However, PEN is generally considerably more costly and more difficult to manufacture than PET, so a clear need exists for improving the cuttability of PET-based polyester supports.

Outside the photographic field, poly(ethylene terephthalate) (PET) and poly(ethylene naphthalate) (PEN) are valuable commercial semicrystalline polyesters, which are widely used for packaging materials due to the combination of desirable properties that they possess. The high oxygen barrier properties of these polyesters render them particularly valuable for packaging oxygen-sensitive food and other goods and materials. PEN has advantages over PET due to its higher Tg and higher oxygen barrier properties, although PEN, as mentioned above, is considerably more costly and is somewhat harder to process than PET.

The toughness and cutting difficulty of PET and similar polyesters is generally attributed to the crystal structure and molecular orientation of the film. It is known that changes in these factors, driven either by formulary changes or by modified process conditions, can be used to lower the toughness and improve the cutting performance of PET. Generally, the crystallinity of PET can be lowered or altogether eliminated by adding suitable crystallization modifiers. Crystallization modifiers like isophthalic acid (IPA) and 1,4-cyclohexane dimethanol (CHDM) are often copolymerized into PET and PEN polyesters to form copolyesters that have better processing properties. Modest levels of IPA slow down crystallization and raise the oxygen barrier properties. Higher levels of IPA break up crystallinity and lead to amorphous copolyesters with good barrier properties, but these copolyesters, are known to those skilled in the art, to possess poor impact and other mechanical properties. Modest levels of CHDM also slow down crystallization, but decrease oxygen barrier properties. Higher levels of CHDM are well known to form families of amorphous copolyesters, which are widely used in commerce in a multitude of applications including heavy gauge sheet, signage, medical packages, etc. These copolyesters have excellent impact resistance and other mechanical properties, but have lower oxygen barrier properties than IPA-modified copolyesters and lower oxygen barrier properties than PET.

Amorphous copolyesters are generally defined as copolyesters that do not show a substantial melting point by differential scanning calorimetry. These copolyesters are typically based on terephthalic acid, isophthalic acid, ethylene glycol, neopentyl glycol and 1,4-cyclohexane dimethanol. It is known that amorphous copolyesters possess a combination of desirable properties, such as excellent clarity and color, toughness, chemical resistance and ease of processing. Accordingly, such copolyesters are known to be useful for the manufacture of extruded sheets, packaging materials, and parts for medical devices. For example. U.S. Pat. Nos. 5,385,773 and 5,340,907 to Yau et al. discloses polyesters of 1,4-cyclohexane dimethanol, in which the diol is present in an amount of 10–95 mol % of the glycol component, and a process for producing such copolymers by esterification. U.S. Pat. No. 6,183,848 B1 to Turner et al. discloses an amorphous copolyester comprising various amounts of comonomers derived from 1,4-cyclohexane dimethanol which, because of improved gas barrier properties, are useful for packaging perishable goods. In one embodiment, the copolyester is disclosed as a biaxially oriented sheet. Film and sheet made from various amorphous PET polyesters comprising repeat units from CHDM, are sold by Eastman Chemical Company under the trademark EASTAPAK and EASTAR copolyesters.

PCT WO 01/34391 A1 to Moskala et al. describes a method for improving cutting characteristics of a thermoplastic by forming a multilayer structure including a material that is a copolyester comprising 80 to 100 mol % terephthalic acid, 0 to 20 mol % of a modifying diacid, and 25 to 100 mol % 1,4-cyclohexanedimethanol.

PROBLEM TO BE SOLVED BY THE INVENTION

Accordingly, it would be desirable to provide a PET film base with improved physical properties. In particular, it would be desirable to obtain a PET film base that is less tough and better suited for finishing operations, i.e., slitting, chopping and perforating processes, which are required in the preparation of photographic films. Moreover, it would be desirable to obtain a PET film base that is easier to cut in various steps of the photofinishing process, such as splicing, notching, and sleeving. Additionally, it would be desirable to be able to use PET as a film base in certain consumer photographic film applications and in films processed in a minilab setting. It would also be desirable for such a PET film base to have other advantageous properties such as dimensional stability and a reduced tendency to take up high levels of curl during storage in cartridges at high temperatures and/or is better able to lower this curl during photoprocessing.

SUMMARY OF THE INVENTION

This invention relates to a method for improving the cutting performance of photographic films based on polyester supports, particularly as a replacement to CTA film base. It has been found that the presence in a PET polymer material of a certain amount of monomeric units derived from 1,4-cyclohexane dimethanol (CHDM), also referred to as "CHDM repeat units" or "CHDM-comonomer units," significantly improves the cutting performance of the film base. This can be accomplished either by the addition/blending of polyester polymers containing CHDM monomeric units to PET material and/or the incorporation of CHDM-comonomer units into a PET-polymer backbone at appropriate levels.

Photographic film requires a strict control of the thickness uniformity and surface flatness. One method of control is through stretching of a polymer sheet into a semicrystalline state. For CHDM-modified polyester, only when the concentration of CHDM-comonomer units relative to total glycol/diol content is less than about 25 mol % or at least about 65 mol % is the resulting polyester sufficiently crystalline, such that the material exhibits good dimensional stability and thickness uniformity. Amorphous polyester film or insufficiently crystalline film presents dimensional stability and thickness uniformity problems. However, above about 95 mol %, as when the film base is made of PCT, the polyester crystallizes rapidly, therefore the making of its oriented film is difficult. Also, the PCT becomes opaque or hazy and useless for photographic applications where transparency is required.

Thus, this invention provides an improved poly(ethylene terephthalate) (PET) film base for photographic film or other elements, having excellent dimensional stability, optical clarity and mechanical strength while also possessing an improved cuttability.

In accordance with one embodiment of the invention, a high-CHDM-modified PET resin is blended using a suitable compounding method with a polyester containing CHDM comonomer at an appropriate level, and this blend is then used to prepare a biaxially stretched and heat-set film or sheet material under conditions similar to those used for preparing conventional PET film. In another embodiment of this invention, a modified-PET resin comprising CHDM comonomer at a sufficient level is used to prepare a biaxially stretched and heat-set film or sheet material under conditions similar to those used for preparing conventional PET film.

A further embodiment of the invention is directed towards a photographic element comprising at least one light sensitive silver halide-containing emulsion layer and a PET film base produced in accordance with the above embodiments.

The film base of the present invention has desirable properties for use in photographic elements. These include good stiffness, low tear strength and improved cuttability. Definitions of terms, as used herein, include the following:

By "terephthalic acid," suitable synthetic equivalents, such as dimethyl terephthalate, are included. It should be understood that "dicarboxylic acids" includes the corresponding acid anhydrides, esters and acid chlorides for these acids. Regarding the glycol/diol component or acid component in a polymer or material, the mol percentages referred to herein equal a total of 100 mol %. "PET polymer," "PET resin," "poly(ethylene terephthalate) resin," and the like refers to a polyester comprising at least 98 mol % terephthalic-acid comonomer units, based on the total acid component, and comprising at least 98 mol % of ethylene-glycol comonomer units, based on the total glycol component. This includes PET resins comprising 100 mol % terephthalic-acid comonomer units, based on the total acid component, and comprising 100 mol % of ethylene-glycol comonomer units, based on the total glycol component.

The term "modified PET polymer," "modified PET resin," or the like is a polyester comprising at least 70 mol % terephthalic-acid comonomer units, based on the total acid component, that has been modified so that either the acid component is less than 98 mol % (including less than 95 mol %) of terephthalic-acid ("TA") comonomer units or the glycol component is less than 98 mol % (including less than 95 mol %) of ethylene glycol ("EG") comonomer units, or both the TA and EG comonomers units are in an amount less than 98 mol % (including less than 95 mol %). The modified PET polymer is modified with, or copolymerized with, one or more other types of comonomers other than terephthalic-acid comonomer and/or ethylene-glycol comonomers, in an amount of greater than 2 mol % % (including greater than 5 mol %) of either the acid component and/or the glycol component, for example, to improve the cuttability of a film base or otherwise change the properties of the film base in which it is used. The "modified PET resin" does not necessarily need to contain any ethylene glycol derived comonomer, and it does not necessarily need to contain any acid component other than terephthalic acid.

The term "CHDM-modified PET" or "CHDM-modified-PET polyester" or "CHDM-modified PET resin" refers to a modified-PET polymer modified by the inclusion of at least 65 mol % CHDM-comonomer units, base don the total glycol component.

Similarly, the term "CHDM-modified polyester" refers to a polyester comprising at least 65 mol % CHDM-comonomer units, based on total glycol component, but not necessarily comprising any specific amount of terephthalic-acid comonomer units.

The term "high-CHDM-modified PET" refers to a CHDM-modified PET polyester in which the level of CHDM-comonomer units is equal to or greater than 95 mol % (including 100 mol %). This includes both "PCT" (polycyclohexylene dimethylene terephthalate) and "PCTA," which is a copolymer of three monomers: terephthalic acid, isophthalic acid and 1,4-cyclohexane dimethanol, with 100 mol % of the 1,4-cyclohexane dimethanol based on its glycol component.

The term "high-CHDM-modified polyester" refers to a CHDM-modified polyester in which the level of CHDM-comonomer units is greater than 95 mol % (including 100 mol %), but not necessarily comprising any amount of terephthalic-acid comonomer units.

"PET-based-polyester material" is a material comprising one or more polymers wherein at least 70% by weight of the material is one or more modified PET polymers. Optionally, the materially may also include addenda such as silica beads, plasticizers, and the like.

A film base is made using a "PET-based-polyester material" in the present invention

DETAILED DESCRIPTION OF THE INVENTION

As indicated above, in one embodiment of the invention, a high-CHDM-modified PET resin is blended, using a suitable compounding method, with a polyester containing CHDM-comonomer units at a sufficient level. This resin is then used to prepare a biaxially stretched and heat-set film under conditions similar to those used for preparing PET film base. In another embodiment of this invention a modified-PET resin comprising CHDM comonomer at a sufficient level is used to prepare a biaxially stretched and heat-set film under conditions similar to those used for preparing PET film base. Typically, biaxially stretching the material causes amorphous material to become semicrystalline. In a typical embodiment, the crystallinity is at least 10%.

More particularly, the photographic film base according to the present invention comprises a PET-based polyester material comprising one or more polyester resins, in which material the level of repeat units derived from 1,4-cyclohexane dimethanol (CHDM) is overall 65 to 95 mol %, based on total glycol component in the material, such that the cutting index (as defined in Equations 1 and 2 below) of said film base is less than 4.6, preferably less than about 3.5. Preferably, the film base comprises a material in which the level of repeat units derived from 1,4-cyclohexane dimethanol is 70 to 95 mol %, based on total glycol component in the material, and the cutting index of said film base is less than 4.6, preferably less than 3.5. Also, preferably, less than 25 mol % of the total glycol units are aromatic.

In the case of a blend, the film base of the present invention comprises a polyester material comprising a first polyester that is a high-CHDM-modified PET polymer that is blended with a second polyester, the second polyester comprising repeat units derived from 1,4-cyclohexane dimethanol such that the total repeat units derived from 1,4-cyclohexane dimethanol in the polyester materials is at a level between 65 to 95 mol % based on total glycol component in the polyester. All polyester materials in the blend must be miscible, that is, the film produced from said blend must be optically clear, to meet the stringent optical requirements of high transparency and low haze placed on photographic film bases.

More preferably, the film base comprising the PET-based polyester material has a cutting index of less than 3.0, most preferably less than about 2.0, optimally equal to or less than about 1.5. Preferably, also, the repeat units derived from 1,4-cyclohexane dimethanol in the material are at a level of greater than 70, more preferably greater than 75 mol % based on total glycol component in the polyester.

As indicated above, the film base is useful in a photographic element comprising at least one silver-halide imaging layer over a support comprising a film base. Such a photographic element can be a photographic film or a photothermographic film.

In addition to the film base according to the present invention, the support can further comprise one or more photographically acceptable subbing layers, backing layers, tie layers, magnetic recording layers and the like.

Subbing layers are used for the purpose of providing an adhesive force between the polyester support and an overlying photographic emulsion comprising a binder such as gelatin, because a polyester film is of a very strongly hydrophobic nature and the emulsion is a hydrophilic colloid. If the adhesion between the photographic layers and the support is insufficient, several practical problems arise such as delamination of the photographic layers from the support at the cut edges of the photographic material, which can generate many small fragments of chipped-off emulsion layers which then cause spot defects in the imaging areas of the photographic material.

Various subbing processes and materials have, therefore, been used or proposed in order to produce improved adhesion between the support film and the hydrophilic colloid layer. For example, a photographic support may be initially treated with an adhesion promoting agent such as, for example, one containing at least one of resorcinol, catechol, pyrogallol, 1-naphthol, 2,4-dinitro-phenol, 2,4,6-trinitrophenol, 4-chlororesorcinol, 2,4-dihydroxy toluene, 1,3-naphthalenediol, 1,6-naphthalenediol, acrylic acid, sodium salt of 1-naphthol-4-sulfonic acid, benzyl alcohol, trichloroacetic acid, dichloroacetic acid, o-hydroxybenzotrifluoride, m-hydroxybenzotrifluoride, o-fluorophenol, m-fluorophenol, p-fluorophenol, chloralhydrate, and p-chloro-m-cresol. Polymers are also known and used in what is referred to as a subbing layer for promoting adhesion between a support and an emulsion layer. Examples of suitable polymers for this purpose are disclosed in U.S. Pat. Nos. 2,627,088; 2,968,241; 2,764,520; 2,864,755; 2,864,756; 2,972,534; 3,057,792; 3,071,466; 3,072,483; 3,143,421; 3,145,105; 3,145,242; 3,360,448; 3,376,208; 3,462,335; 3,475,193; 3,501,301; 3,944,699; 4,087,574, 4,098,952; 4,363,872; 4,394,442; 4,689,359; 4,857,396, British Patent Nos. 788,365; 804,005; 891,469; and European Patent No. 035,614. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidylmethacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. Materials used in adhesion-promoting layers often comprise a copolymer containing a chloride group such as vinylidene chloride.

In general, as is well known by the skilled artisan, polyesters comprise the reaction product of at least one dicarboxylic acid and at least one glycol component. The dicarboxylic acid component can typically comprise residues of terephthalic acid, isophthalic acid, 1,4-cyclohexanedicarboxylic acid, 2,6-naphthalenedicarboxylic acid, and/or mixtures thereof. Also suitable are the anhydrides thereof, acid chlorides thereof, and lower, e.g., C1–C8 alkyl esters thereof. Any isomers of the dicarboxylic acid component or mixtures thereof may be used. For example, cis, trans, or cis/trans mixtures of 1,4-cyclohexanedicarboxylic acid may be employed. Examples of suitable naphthalene dicarboxylic acid isomers include 1,4-naphthalenedicarboxylic acid, 2-6-naphthalenedicarboxylic acid, 2,7-naphthalenedicarboxylic acid or mixtures thereof In one embodiment of the invention, the CHDM-modified-PET polyesters used in the film base comprise copolyesters having a dicarboxylic acid component and a glycol component, the dicarboxylic acid component comprising repeat units from at least 80 mol % terephthalic acid (or its ester) and the glycol component comprising at least 65 mol %, preferably 70 to 95 mol %, of repeat units from 1,4-cyclohexane dimethanol and about 5 to 35 mol % from another glycol, preferably 5–30 mol % from ethylene glycol.

The CHDM-modified-PET polyesters used in making the articles of this invention preferably have about 100 mol % of a dicarboxylic acid portion and about 100 mol % of a glycol portion. Less than about 20 mol %, preferably not more than about 10 mol % of the dicarboxylic acid repeat units may be from other conventional acids such as those selected from succinic, glutaric, adipic, azelaic, sebacic, fumaric, maleic, itaconic, 1,4-cyclohexane-dicarboxylic, phthalic, isophthalic, and naphthalene dicarboxylic acid.

Preferably, the glycol component of the CHDM-modified-PET polyesters contains repeat units comprising from 65 to 100 mol % of 1,4-cyclohexane dimethanol and from about 5 to 35 mol % of ethylene glycol. The glycol component may optionally include less than 35 mol %, preferably not more than about 10 mol % of other conventional glycols such as propylene glycol, 1,3-propanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 1,3-butanediol, 1,4-butanediol, neopentyl glycol, 1,5-pentanediol, 1,6-hexanediol, 1,8-octanediol, 2,2,4-trimethyl-1,6-hexanediol, thiodiethanol, 1,2-cyclohexanedimethanol, 1,3-cyclohexanedimethanol, 2,2,4,4-tetramethyl-1,3-cyclobutanediol and the like.

In the case of embodiments involving blends, a blend comprising at least one high-CHDM-modified PET polymer blended with a suitable CHDM-modified polyester, such that the total content of the CHDM-comonomer units in the blend is 65 to 100 mol %, preferably at least 70 mol %, more preferably at least 75 mol %. In the CHDM-modified polyester, any of the above-mentioned acid components may be used and any of the above glycol components may be used in addition to the CHDM component.

In one embodiment, a preferred CHDM-modified PET for use in the present invention is represented by the following structure:

I

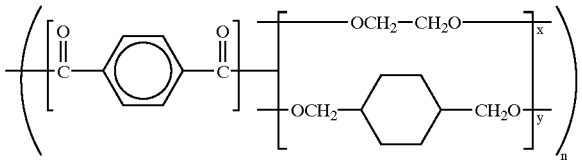

In Structure (I) above, the subscripts x and y represent the mol %, based on the total glycol component of the comonomer. Preferably, as indicated above, x is 5 to 35 mol % and y is between 65 and 95 mol %.

Another embodiment of the invention involves a film base made of a PET-based polyester material comprising one or more polyester resins, in which material the level of repeat units derived from 1,4-cyclohane dimethanol, based on the total glycol component, is 65 to 100 mol %, and the level of repeat units derived from an acid component other than terephthalic acid or its ester is in the amount of 3 to 30 mol %, preferably 5 to 20, based on the total acid component, and wherein the cutting index of the film base is less than 4.6, preferably 3.5, more preferably less than 2.0.

The acid component other than terephthalic acid can, for example, isophthalic acid (IPA), dimethyl isophthalate, 1,4-cyclohexanedicarboxylic acid (1,4-CHDA), 1,4 cyclohexanediacetic acid, diphenyl-4,4-dicarboxylic acid, dimethyl-2,6-naphthalene-dicarboxylate, succinic acid, glutaric acid, adipic acid, azelaic acid, sebacic acid, paraphenylenedicarboxylic acid (PPDA), naphthalenedicarboxylic acid (NDA), and mixtures thereof. Preferably, the other acid component is isophthalic acid (IPA), 1,4-cyclohexanedicarboxylic acid (1,4-CHDA), paraphenylenedicarboxylic acid (PPDA), naphthalenedicarboxylic acid (NDA), and the like, and mixtures thereof.

Preferably, in one embodiment, a blend comprises a poly cyclohexanedimethylene terephthalate (PCT) polymer and a CHDM-modified polymer in the ratio of 95:5 to 5:95, more preferably 80:30 to 20:70. Preferably, the level of the CHDM-comonomer units in the CHDM-modified polymer is 65 to 95. Preferably, the blend comprises a poly cyclohexanedimethylene terephthalate (PCT) polymer and a CHDM-modified polymer in the ratio of 95:5 to 5:95. Preferably, the total content of the CHDM comonomer units in the CHDM-modified polymer is 65 to 95 mol %.

The polyester polymers used in the present invention can be prepared by a process comprising reacting the dicarboxylic acid component and the glycol component at temperatures sufficient to effect esterification or ester exchange and polycondensing the reaction product under an absolute pressure of less than 10 mm Hg for a time of less than about 2 hours in the presence of a catalyst and inhibitor system. An example of a preferred catalyst and inhibitor system is about 0–75 ppm Mn, about 50–150 ppm Zn, about 5–200 ppm Ge, about 5–20 ppm Ti and about 10–80 ppm P, all parts by weight based on the weight of the copolyester.

Either dimethyl terephthalate (or other lower dialkyl terephthalate ester) or terephthalic acid can be used in producing the copolyester. Thus, the term "terephthalic acid component, monomer, repeat unit, or portion" herein is meant to include either the acid or ester form. These materials are commercially available. The glycols CHDM and ethylene glycol are also commercially available. Either the cis or trans isomer of CHDM, or mixture thereof, may be used in accordance with the present invention.

Generally, the copolyesters may be produced using conventional polyesterification procedures described, for example, in U.S. Pat. Nos. 3,305,604 and 2,901,460, the disclosures of which are incorporated herein by reference. The amorphous or semi-crystalline copolyesters according to the invention are prepared by conventional polymerization processes known in the art, such as disclosed by U.S. Pat. Nos. 4,093,603 and 5,681,918, the disclosures of which are herein incorporated by reference. Examples of polycondensation processes useful in making the PET material of the present invention include melt phase processes conducted with the introduction of an inert gas stream, such as nitrogen, to shift the equilibrium and advance to high molecular weight or the more conventional vacuum melt phase polycondensations, at temperatures ranging from about 240° C. to about 300° C. or higher, which are practiced commercially. Although not required, conventional additives may be added to the copolyester materials of the invention in typical amounts. Such additives include pigments, colorants, stabilizers, antioxidants, extrusion aids, slip agents, carbon black, flame retardants and mixtures thereof.

Various modified-PET polyesters comprising repeat units from CHDM, which can be used in the present invention, are commercially available from Eastman Chemical Company (Kingsport, Tenn.) under the trademark EASTAPAK and EASTAR copolyester, as described at http://www.eastman.com.

Photographic elements of this invention can have the structures and components shown in Research Disclosure Item 37038 cited above and can be imagewise exposed and processed using known techniques and compositions, including those described in the Research Disclosure Item 37038 cited above.

The film base may be manufactured by a process of casting, biaxial stretching and heat-setting. The process for making PET film base typically comprises the steps of casting a molten PET resin onto a casting surface along the machine direction to form a continuous sheet, drafting the sheet by stretching in the machine direction, tentering the sheet by stretching in the transverse direction, heat-setting the drafted and tentered sheet, and cooling the heat-set sheet to form a stretched, heat-set PET film, such as described in, e.g., U.S. Pat. No. 4,141,735 to Schrader et al., the disclosure of which is incorporated in its entirety by reference herein. Alternately, the stretching of the film in the machine and transverse directions can be performed simultaneously using appropriate machinery.

Preferably, in order to improve its dimensional stability, the film base is heat treated at temperatures from Tg–50° C. up to Tg for times ranging from 1 hr to 1000 hrs, where Tg is the glass transition temperature of the PET-based polyester material.

In one particular embodiment, the process for preparing films from the resin compositions of this invention comprises the following steps:

(1) The resin is cast under molten conditions upon a cooling surface to form a continuous cast sheet. Preferably, the molten polyester resin has an inherent viscosity of from 0.5 to 0.9 dl/g, and is cast at a temperature of from 250 to 310° C. while the casting surface has a temperature of from 40 to 70° C. The inherent viscosity (IV) is measured at 25° C. in a solvent mixture of phenol/chlorobenzene (60/40 by weight) at a concentration of 0.25 g/dl with a Ubbelhode glass viscometer.

(2) The continuous sheet is removed from the casting surface and passed into a drafting zone where it is first preheated and then stretched in the machine direction at a stretch ratio of 2.0 to 4.0, at a temperature of from about 80° C. to 120° C. The drafting zone typically includes two sets of nipped rollers, the first being the entrance to the drafting zone and the second the exit from the drafting zone. To achieve the stretch ratios necessary for the practice of this invention, the exit nip rollers are rotated at a speed greater than the entrance nip rollers. The film may be cooled in the last stage of the drafting zone to 25° C. To-do 60° C.

(3) The film moves from the drafting zone into a tentering zone where it is preheated and stretched in the transverse direction at a stretch ratio of 2.0 to 4.0, at a temperature of from about 80° C. to 120° C. The tentering zone typically includes a means for engaging the film at its edges and stretching such that the final width is from 2.0 to 4.0 times that of the original width.

(4) The film is next heat-set by maintaining it at a temperature of at least 180° C., but below the melting point of the resin, preferably at least 200° C. to 250° C., while being constrained, as in the tentering zone, for a time sufficient to affect heat-setting. Times longer than necessary to bring about this result are not detrimental to the film, however, longer times are undesired as the lengthening of the zone requires higher capital expenditure without achieving additional advantage. The heat-setting step is typically accomplished within a time period of 0.1 to 15 seconds and preferably 0.1 to 10 seconds. Finally, the film is cooled without substantial detentering (the means for holding the edges of the film do not permit greater than 2% shrinkage thereof).

With regard to cuttability, it is generally known in the art of sheet material cutting that the cutting process combines crack formation and propagation. To form a crack, one needs to apply cutters to cause compression on the surfaces of the sheet material until the material is deformed and its break point is reached. Once the material's break point is reached, a crack would be formed, which starts the second stage of cutting—crack propagation. One can maintain and eventually complete the cutting process by compressing the sheet material further using the cutters. Eventually, the cutting would be completed as cracks propagate through the sheet thickness.

To evaluate the cuttability of a given material, one needs to evaluate how the material behaves during the crack formation and propagation stages. If the material absorbs and dissipates more mechanical energy during the crack formation and propagation processes, it is said to be more difficult to cut and will have a lower cuttability. Two standard tests can be used to evaluate how much mechanical energy a material absorbs and dissipates during the said crack formation and propagation steps. One is the tensile test (ASTM D882) and the other is the tear test (ASTM D1938). The former can be used to evaluate the crack formation part of the cutting process, and the latter can be used to assess the crack propagation part of the cutting process.

The mechanical and cutting properties of the polyester films of the present invention were evaluated in accordance with the following procedures:

Tensile Properties: Modulus and tensile toughness can be determined using a tensile test such as that described in ASTM D882. A tensile test consists of pulling a sample of material with a tensile load at a specified rate until it breaks. The test sample used may have a circular or a rectangular cross section. From the load and elongation history, a stress-strain curve is obtained with the strain being plotted on the x-axis and stress on the y-axis. The modulus is defined as the slope of the initial linear portion of the stress-strain curve. The modulus is a measure of the stiffness of the material. The tensile toughness is defined as the area under the entire stress-strain curve up to the fracture point. The tensile toughness is a measure of the ability of a material to absorb energy in a tensile deformation. Both modulus and tensile toughness are fundamental mechanical properties of the material.

Tear Strength: The resistance to tear can be determined using a tear test such as that described in ASTM D1938. The test measures the force to propagate tearing in a fracture mode III. The test sample used has a rectangular shape and a sharp long cut in the middle. The separated two arms are then fixed in a conventional testing machine such as Instron.® The fixtures move at constant speed to prolong the preexisting cut and the steady state force of tearing is recorded.

Cutting Index: It is generally known that tensile toughness represents the energy required to initiate a crack, while fracture toughness determines the energy needed to further propagate the crack. As typical cutting processes involve both crack initiation and crack propagation, a quantity of cuttability can be defined based on these two fundamental material quantities. Tensile toughness can be evaluated through tensile testing. Fracture toughness $G_c$ can be calculated from the tear strength $$G_c=2P_c/b \tag{1}$$

where $P_c$ is the load at tear crack growth and b is the specimen thickness. (See Rivlin, R. S. & Thomas, A. G., (1953), *J. Polym. Sci.,* 10, 291).

For practical simplicity, a dimensionless quantity of cutting index is defined as follows, $$C=0.5W_t/W_{tr}+0.5G_c/G_{cr} \tag{2}$$

where C is the cutting index, $W_t$ is tensile toughness and $G_c$ is fracture toughness, and $W_{tr}$ and $G_{cr}$ are the corresponding properties of a reference material, where CTA is selected as the reference material of this invention. The cutting indices of commonly used film base materials such as PET, PEN and CTA correspond well to their practical cutting performance. Generally, it is desirable for C to be close to 1 (CTA value).

The polyester films having the properties set forth above and prepared by the process described above are less likely to fail and more likely to produce cleaner cut surfaces in various cutting operations. In fact, the films prepared in accordance with this invention compare favorably with CTA, which has been the film base of choice for a long time in the photographic industry because of its special physical characteristics.

The present invention is described in greater detail below by referring to the Examples. However, the present invention should not be construed as being limited thereto.

EXAMPLES

Materials

The modified poly(ethylene terephthalate)-based films in the following examples were prepared using the following materials.

1) Comparison EASTAPAK PET Polyester 7352 (Trademark of Eastman Chemical Company, USA) is a poly(ethylene terephthalate) resin.

2) EASTAR PCTG Copolyester 5445 (Trademark of Eastman Chemical Company, USA) is a copolymer of poly(ethylene terephthalate) and poly(cyclohexane dimethylene terephthalate) with approximately 62 mol % of 1,4-cyclohexane dimethanol of its total diol component.

3) PCT 3897 (Trademark of Eastman Chemical Company, USA) is a poly(cyclohexylene dimethylene terephthalate).

4) EASTAR Copolyester A150 (Trademark of Eastman Chemical Company, USA) is a copolyester comprising three monomers: terephthalic acid, isophthalic acid and cyclohexane dimethanol with 100 mol % of 1,4-cyclohexane dimethanol as its diol component, and approximately 17 mol % of isophthalic acid and 83 mol % of terephthalic acid as its diacid components.

5) Polymer Blend PETG-65: EASTAR PCTG Co polyester 5445 and PCT3897 were mixed at a weight ratio of 91:9, dried at 150° F. for 24 hours and then melt kneaded extruded at 600° F. using a twin screw extruder, resulting in 65 mol % of 1,4-cyclohexane dimethanol of its total diol component.

6) Polymer Blend PETG-70: EASTAR PCTG Copolyester 5445 and PCT3897 were mixed at a weight ratio of 77:23, dried at 150° F. for 24 hours and then extruded at 600° F. using a twin screw extruder, resulting in 70 mol % of 1,4-cyclohexane dimethanol of its total diol component.

7) Polymer Blend PETG-80: EASTAR PCTG Copolyester 5445 and PCT3897 were mixed at a weight ratio of 50/50 dried at 150° F. for 24 hours and then melt kneaded extruded at 600° F. using a twin screw extruder, resulting in a total composition of 80 mol % of 1,4-cyclohexane dimethanol of its total diol component.

8) Polymer Blend PETG-90: EASTAR PCTG Copolyester 5445 and PCT3897 were mixed at a weight ratio of 24:76, dried at 150° F. for 24 hours and then melt kneaded extruded at 600° F. using a twin screw extruder, resulting in a composition of 90 mol % of 1,4-cyclohexane dimethanol of its total diol component.

Film Formation of Poly(ethylene Terephthalate)-Based Support

The poly(ethylene terephthalate)-based materials listed above were processed into film by first drying pellets of said materials under suitable conditions. The pellets were then melted at 530° F. using a single screw extruder, and cast onto an electrostatically charged casting drum at 110° F. to prepare a cast sheet.

The cast sheet obtained was subjected to biaxial stretching, either simultaneously or sequentially, by 3 to 4 times in each direction. The stretched film had a final thickness of 3 to 5 mils.

Evaluation

The methods of characterization and measurement are described below.

Tensile Property

All tests were performed in accordance with ASTM D 882-80a in a standard environment of 50% RH and 73° F. The tensile test was conducted using a Sintech® 2 operated via Testwork® version 4.5 software with an Instron® frame and load cell. A load cell of 200 lbs. and a pair of grips of one flat and one point face were used. The sample size was 0.6 in. wide by 4 in. long (gauge length). The crosshead speed was set at 2 inch/min. Five specimens were tested for one sample, and the average and standard deviation were reported. A coefficient of variation of 5% for the modulus, 12% for the tensile strength and 15% for the elongation to break was generally observed, which includes the variation in the material and the measurement.

Tear Strength

All tear tests were performed in accordance with ASTM D1938 in a standard environment of 50% RH and 73° F. The tear test was conducted using a Sintech® 2 operated via Testwork® version 4.5 software with an Instron® frame and load cell. The sample size was 1 inch wide by 3 inch long. A cut of 1 inch long was first made at the center of the width using a pair of sharp scissors. Then two arms were put between two jaws to be stretched. A load cell of 2 kg and a pair of grips of flat faces were used. The crosshead speed was set at 10 inch/min. The tear strength was reported by normalizing the average peak load by the thickness of the film.

Comparative Example

Poly(ethylene terephthalate) (sold as EASTAPAK PET 7352 by Eastman Chemical Company, USA) was extruded through a sheeting die and cast on a chill roll. The cast sheets were stretched biaxially at a ratio of 3×3 to form the comparative 3.6 mil thick film Sample C-1. The resulting film was evaluated for tensile and tear properties. The results are reported in Table 1 below where the corresponding values for CTA film (Sample C-2) are also listed.

TABLE 1

| Property | | Sample C-1 | Sample C-2 |
|---|---|---|---|
| Thickness | mil | 3.6 | 4.9 |
| | μm | 92 | 124 |
| Break elongation | % | 105.8 | 24.4 |
| Young's modulus | $10^3$ psi | 657.2 | 553 |
| | GPa | 4.5 | 3.8 |
| Break strength | $10^3$ psi | 29.9 | 13.9 |
| | MPa | 206.2 | 95.7 |
| Yield strength | $10^3$ psi | 13.7 | 10.5 |
| | MPa | 94.4 | 72.6 |
| Tensile toughness | ft*lbf/in$^3$ | 1659.6 | 230 |
| | MPa | 137.3 | 19 |
| Tear strength | g/mil | 21.2 | 5.7 |
| | g/100 μm | 83.3 | 22.4 |
| Cutting index | | 5.5 | 1 |

Example 1

Material PETG-65, a blend of PCTG 5445 (62 mol % CHDM-comonomer units) and PCT (100 mol % CHDM) resulting in an overall total of 65 mol % of CHDM-comonomer units, was extruded through a sheeting die and cast on a chill roll. The cast sheets were stretched biaxially at 100° C. at a ratio of 3.4×3.4 to form a 3.0 mil thick film ample No. 1. The resulting film was evaluated for tensile and tear properties. The results are reported in TABLE 2.

TABLE 2

| Property | | Sample Number 1 | Comparative Sample C-1 |
|---|---|---|---|
| Thickness | mil | 3.0 | 3.6 |
| | μm | 76 | 92 |
| Break elongation | % | 49.4 | 105.8 |
| Young's modulus | $10^3$ psi | 390.0 | 657.2 |
| | GPa | 2.7 | 4.5 |
| Break strength | $10^3$ psi | 19.7 | 29.9 |
| | MPa | 135.7 | 206.2 |
| Yield strength | $10^3$ psi | 10.4 | 13.7 |
| | MPa | 71.7 | 94.4 |
| Tensile toughness, | ft*lbf/in$^3$ | 555.3 | 1659.6 |
| | MPa | 45.9 | 137.3 |
| Tear strength | g/mil | 2.4 | 21.2 |
| | g/100 μm | 9.5 | 83.3 |
| Cutting index | | 1.4 | 5.5 |

Example 2

Material PETG-70, a blend of PCTG 5445 (62 mol % CHDM-comonomer units) and PCT (100 mol % CHDM) resulting in an overall total of 70 mol % of CHDM-comonomer units, was extruded through a sheeting die and cast on a chill roll. The cast sheets were stretched biaxially at 104° C. at a ratio of 3.0×3.0 to form a 5.0 mil thick film (Sample No. 2). The resulting film was evaluated for tensile and tear properties. The results are reported in Table 3 below.

TABLE 3

| Property | | Sample Number 2 | Comparative Sample C-1 |
|---|---|---|---|
| Thickness | mil | 5.0 | 3.6 |
| | μm | 127 | 92 |
| Break elongation | % | 48.4 | 105.8 |

TABLE 3-continued

| Property | | Sample Number 2 | Comparative Sample C-1 |
|---|---|---|---|
| Young's modulus | $10^3$ psi | 353.3 | 657.2 |
| | GPa | 2.4 | 4.5 |
| Break strength | $10^3$ psi | 17.1 | 29.9 |
| | MPa | 117.9 | 206.2 |
| Yield strength | $10^3$ psi | 10.8 | 13.7 |
| | MPa | 74.5 | 94.4 |
| Tensile toughness | ft*lbf/in$^3$ | 517.0 | 1659.6 |
| | MPa | 42.8 | 137.3 |
| Tear strength | g/mil | 2.0 | 21.2 |
| | g/100 $\mu$m | 7.8 | 83.3 |
| Cutting index | | 1.3 | 5.5 |

Example 3

Material PETG-80, a blend of PCTG 5445 (62 mol % CHDM-comonomer units) and PCT (100 mol % CHDM) resulting in an overall total of 80 mol % CHDM-comonomer units, was extruded through a sheeting die and cast on a chill roll. The cast sheets were stretched biaxially at 104° C. at a ratio of 3.4×3.4 to form a 4.5 mil thick film (Sample No. 3). The resulting film was evaluated for tensile and tear properties. The results are reported in Table 4 below.

TABLE 4

| Property | | Sample Number 3 | Comparative Sample C-1 |
|---|---|---|---|
| Thickness | mil | 4.5 | 3.6 |
| | $\mu$m | 114 | 92 |
| Break elongation | % | 52.4 | 105.8 |
| Young's modulus | $10^3$ psi | 431.3 | 657.2 |
| | GPa | 3.0 | 4.5 |
| Break strength | $10^3$ psi | 18.9 | 29.9 |
| | MPa | 130.4 | 206.2 |
| Yield strength | $10^3$ psi | 11.0 | 13.7 |
| | MPa | 75.8 | 94.4 |
| Tensile toughness | ft*lbf/in$^3$ | 611.5 | 1659.6 |
| | MPa | 50.6 | 137.3 |
| Tear strength | g/mil | 2.2 | 21.2 |
| | g/100 $\mu$m | 8.7 | 83.3 |
| Cutting index | | 1.5 | 5.5 |

Example 4

Material PETG-90, a blend of PCTG 5445 (62 mol % CHDM-comonomer units) and PCT (100 mol % CHDM) resulting in an overall total of 90 mol % of CHDM-comonomer units, was extruded through a sheeting die and cast on a chill roll. The cast sheets were stretched biaxially at 104° C. at a ratio of 3.4×3.4 to form a 3.6 mil thick film (Sample No. 4). The resulting films were evaluated for tensile and tear properties. The results are reported in Table 5.

TABLE 5

| Property | | Sample Number 4 | Comparative Sample C-1 |
|---|---|---|---|
| Thickness | mil | 3.6 | 3.6 |
| | $\mu$m | 91 | 92 |
| Break elongation | % | 45.5 | 105.8 |
| Young's modulus | $10^3$ psi | 480.4 | 657.2 |
| | GPa | 3.3 | 4.5 |

TABLE 5-continued

| Property | | Sample Number 4 | Comparative Sample C-1 |
|---|---|---|---|
| Break strength | $10^3$ psi | 18.8 | 29.9 |
| | MPa | 129.6 | 206.2 |
| Yield strength | $10^3$ psi | 10.8 | 13.7 |
| | MPa | 74.1 | 94.4 |
| Tensile toughness, | ft*lbf/in$^3$ | 516.7 | 1659.6 |
| | MPa | 42.7 | 137.3 |
| Tear strength, | g/mil | 2.2 | 21.2 |
| | g/100 $\mu$m | 8.6 | 83.3 |
| Cutting index | | 1.3 | 5.5 |

Example 5

Resin PCTA 6761 was extruded through a sheeting die and cast on a chill roll. The cast sheets were stretched biaxially at 104° C. at a ratio of 3.4×3.4 to form a 4.7 mil thick film (Sample No. 5). The resulting films were evaluated for tensile and tear properties. The result is reported in Table 6.

TABLE 6

| Property | | Sample Number 5 | Comparative Sample C-1 |
|---|---|---|---|
| Thickness | Mil | 4.7 | 3.6 |
| | $\mu$m | 119 | 92 |
| Break elongation | % | 45.9 | 105.8 |
| Young's modulus | $10^3$ psi | 459.0 | 657.2 |
| | Gpa | 3.2 | 4.5 |
| Break strength | $10^3$ psi | 20.0 | 29.9 |
| | MPa | 137.9 | 206.2 |
| Yield strength | $10^3$ psi | 11.8 | 13.7 |
| | MPa | 81.4 | 94.4 |
| Tensile toughness, | Ft*lbf/in$^3$ | 591.9 | 1659.6 |
| | MPa | 49.0 | 137.3 |
| Tear strength, | g/mil | 3.9 | 21.2 |
| | g/100 $\mu$m | 15.2 | 83.3 |
| Cutting index | | 1.6 | 5.5 |

The results in Tables 2–6 show that incorporation of CHDM unit into a biaxially stretched polyester film, either by blending or by copolymerization, lowers its cutting index and the reduction in cutting index increases the higher the level of CHDM in the film. The reduction in cutting index relative to the comparative sample indicates that the CHDM-containing films have superior cutting performance in various cutting steps of the finishing and photofinishing operations in a manner closer to the performance of CTA.

The invention has been described in detail with particular reference to certain preferred embodiments thereof, but it will be understood that variations and modifications can be effected within the spirit and scope of the invention.

What is claimed is:

1. An imaging element comprising at least one light-sensitive or heat-sensitive imaging layer over a support comprising a biaxially stretched, semicrystalline film base of a PET-based polyester material comprising one or more polyester resins, in which material the total level of repeat units derived from 1,4-cyclohexane dimethanol is 65 to 95 mol %, based on total glycol component in the material, and wherein the cutting index of said film base is less than 4.6.

2. An imaging element comprising at least one light-sensitive or heat-sensitive imaging layer over a support comprising a biaxially stretched, semicrystalline film base comprising a PET-based polyester material comprising one or more polyester resins, in which material the total level of repeat units derived from 1,4-cyclohexyane dimethanol, based on the total glycol component in the material, is 65 to 100 mol %, and wherein the level of repeat units derived from an acid component other than terephthalic acid or its ester is in the amount of 3 to 30 mol %, based on the total acid component, and wherein the cutting index of the film base is less than 4.6.

3. The imaging element of claim 1 or 2 in which the level of repeat units derived from 1,4-cyclohexane dimethanol is at least 70 mol %, based on total glycol component in the material, and the cutting index of said film base is less than 3.5.

4. The imaging element of claim 1 or 2 wherein less than 25% of the total glycol component in the PET-based polyester material is aromatic.

5. The imaging element of claim 1 wherein the PET-based polyester material is a blend comprising at least two polyesters, a first polyester being a high-CHDM-modified PET polyester in which the level of CHDM-comonomer units is above about 95 mol %, and a second polyester comprising repeat units derived from 1,4-cyclohexane dimethanol such that the total repeat units derived from 1,4-cyclohexane dimethanol in the PET-based polyester material is at a level of 65 to 95 mol % based on total glycol component in the polyester material.

6. The imaging element of claim 5, wherein the first polyester in the PET-based polyester blend comprises 100 mol % of CHDM-monomer units, based on the glycol component in the first polyester.

7. The imaging element of claim 5 wherein the second polyester in the PET-based polyester blend is a CHDM-modified-PET polyester.

8. The imaging element of claim 1 or 2 wherein the film base has a cutting index of less than 2.0.

9. The imaging element of claim 1 or 2 wherein the repeat units derived from 1,4-cyclohexane dimethanol in the PET-based polyester material is at a level of above 75 mol % based on total glycol component in the material.

10. The imaging element of claim 1 or 2 wherein the film base is manufactured by a process of melt extrusion, casting, biaxial stretching and heat-setting.

11. The imaging element of claim 1 or 2 wherein the film base has been heat treated at temperatures from Tg−50° C. up to Tg for times ranging from 1 hr to 1000 hrs, where Tg is the glass transition temperature of said material.

12. The imaging element of claim 1 or 2 wherein the imaging layer comprises a silver-halide emulsion.

13. The imaging element of claim 1 or 2 wherein the light-sensitive imaging layer is sensitive to X-ray exposure.

14. The imaging element of claim 1 or 2 wherein the element is a photographic film or a photothermographic film.

15. The imaging element of claim 14 wherein the element is a 35 mm photographic film.

16. The imaging element of claim 1 or 2 further comprising a film base with one or more photographically acceptable subbing layers and/or backing layers coated thereon.

17. The imaging element of claim 1 or 2 wherein the film base bears a magnetic or optical recording layer.

18. The imaging element of claim 2 wherein the acid component other than terephthalic acid in the PET-based polyester material is selected from the group consisting of isophthalic acid, 1,4-cyclohexanedicarboxylic acid, para-phenylenedicarboxylic acid, naphthalenedicarboxylic acid and derivatives thereof.

19. An imaging element comprising at least one light-sensitive or heat-sensitive imaging layer over a support comprising a biaxially stretched, semicrystalline film base of a PET-based polyester material in which material the total level of repeat units derived from 1,4-cyclohexane dimethanol is 65 to 95 mol %, based on total glycol component in the material, wherein the PET-based polyester material comprises a blend comprising at least two polyesters, a first polyester being a high-CHDM-modified PET polyester in which the level of CHDM-comonomer units is above about 95 mol %, and a second polyester being a CHDM-modified-PET polyester, wherein the cutting index of said film base is less than 3.5.

20. An imaging element comprising at least one light-sensitive or heat-sensitive imaging layer over a support comprising a biaxially stretched, semicrystalline film base comprising a PET-based polyester material comprising one or more polyester resins, in which material the total level of repeat units derived from 1,4-cyclohexane dimethanol, based on the total glycol component in the material, is 65 to 100 mol %, and wherein the level of repeat units derived from an acid component other than terephthalic acid or its ester is in the amount of 3 to 30 mol %, based on the total acid component, wherein the film base has been manufactured by a process of melt extrusion, casting, biaxial stretching and has been heat treated at temperatures from Tg−50° C. up to Tg for a time ranging from 1 hr to 1000 hrs, where Tg is the glass transition temperature of said material, and wherein the cutting index of the film base is less than 3.5.

* * * * *